US006065422A

United States Patent [19]

Davidson et al.

[11] Patent Number: 6,065,422

[45] Date of Patent: May 23, 2000

[54] MULTI-FUNCTION BOAT SEAT MOUNT

[75] Inventors: Andrew M. Davidson; Samuel L. Davidson, both of Monroe, La.

[73] Assignee: Duracraft Marine Corporation, Delhi, La.

[21] Appl. No.: 09/332,938

[22] Filed: Jun. 15, 1999

[51] Int. Cl.[7] ..... B63B 17/00

[52] U.S. Cl. ..... 114/363; 248/503.1

[58] Field of Search ..... 114/363; 248/222.11, 248/225.11, 304, 500, 503.1; 297/252, 352

[56] References Cited

U.S. PATENT DOCUMENTS

| | | | |
|---|---|---|---|
| 3,591,112 | 7/1971 | Garmhausen | 114/363 |
| 4,281,426 | 8/1981 | Moeser | 114/363 |
| 5,590,619 | 1/1997 | Meador et al. | 114/363 |
| 5,775,251 | 7/1998 | Morningstar | 114/363 |

*Primary Examiner*—Stephen Avila
*Attorney, Agent, or Firm*—Jacobson, Price, Holman & Stern, PLLC

[57] ABSTRACT

A multi-function boat seat mount enables a single boat seat to be selectively attached to a seat mounting rail on a boat deck, or a pedestal support. The mounting system converts a prior art seat mounting plate on the bottom of a seat which includes a connector adapted to be attached to a complementary connector on a seat mounting rail, to a pedestal mounted seat. To this end, a separate pedestal mounting plate is provided which includes a rail having substantially the same configuration as the seat mounting rail. The pedestal mounting plate can thereby be connected to the seat mounting plate with a spring-loaded catch on the pedestal mounting plate engaging the trailing edges of the seat mounting plate. A spyder is carried by the bottom of the pedestal mounting plate with a pedestal element telescopingly engageable with a pedestal pole rotatably carried in a bushing on a pedestal base attached to the boat deck.

16 Claims, 3 Drawing Sheets

MULTI-FUNCTION BOAT SEAT MOUNT

FIELD OF THE INVENTION

This invention relates to a boat seat, and relates more particularly to a multi-function boat seat mount adapted to selectively attach a boat seat directly to the boat deck at one location, or to a pedestal support at another location.

BACKGROUND OF THE INVENTION

Incorporation of one or more seats, particularly in open boats designed for fishing and relaxation purposes, is well known. One well known technique for removably securing a seat to a boat deck is to provide a seat mounting rail on the boat and a mounting plate on the bottom of the seat having complementary connectors. Seat mounting rails may be located in more than one position in the boat and the complementary connectors may be such that more than one seat can be secured to a single rail. In addition to the seats mounted on the rail, one or more additional seats may be mounted on a swivel type of pedestal base to support a fisherman in an elevated position. Regardless of the configuration, heretofore it has been necessary to provide a plurality of independent seat assemblies, designed either for attachment to the seat mounting rail or the pedestal base, but not adapted for movement between both positions. Such an arrangement is obviously inefficient and costly.

SUMMARY OF THE INVENTION

It is, therefore, a primmy object of the instant invention to provide a seat assembly including a multi-function boat seat mount which enables a single seat to be selectively attached to a seat mounting rail at one location on a boat, or a pedestal support at another location on the boat.

Another object of this invention is the provision of a pedestal mounting plate which can be removably attached to a standard prior art seat mounting plate commonly fixed to the underside of a boat seat. The prior art seat mounting plate includes a connector which is complementary to a connector on the seat mounting rail. The pedestal mounting plate of this invention incorporates a rail element defining a connector which is substantially the same as the connector in the seat mounting rail. This enables the pedestal mounting plate rail to be engaged with the connector on the seat mounting plate in lieu of the seat mounting rail. A catch on the pedestal mounting plate completes the connection of the pedestal mounting plate to the seat mounting plate so that a spyder, carried by the pedestal mounting plate, can be selectively engaged with a pedestal support on the boat itself to mount the seat in an elevated position. In this manner, the standard seat mounting assembly designed for use with a mounting rail fixed to the boat deck is readily converted to a seat mounting assembly adapted for engagement with a pedestal support on the boat.

A further object of this invention is the provision of a pedestal mounting plate assembly attachable to the seat mounting plate assembly to modify the same for attachment to a pedestal support rather than a mounting rail on the boat without the need for tools of any kind.

Yet another object of the instant inventive concepts is the provision of a multi-function boat seat mount including a pedestal mounting plate which is relatively small, easily stored and inexpensive to manufacture, yet quickly attachable to a standard boat seat mounting assembly to convert the same to a pedestal seat.

These and other objects of the invention, as well as many of the attendant advantages hereof will become more readily apparent when reference is made to the following description taken in conjunction with the accompanying drawings.

BRIEF DESCRIPTION OF THE DRAWINGS

Like reference characters refer to like parts throughout the several views of the drawings.

DETAILED DESCRIPTION OF THE PREFERRED EMBODIMENTS

Figure 1:
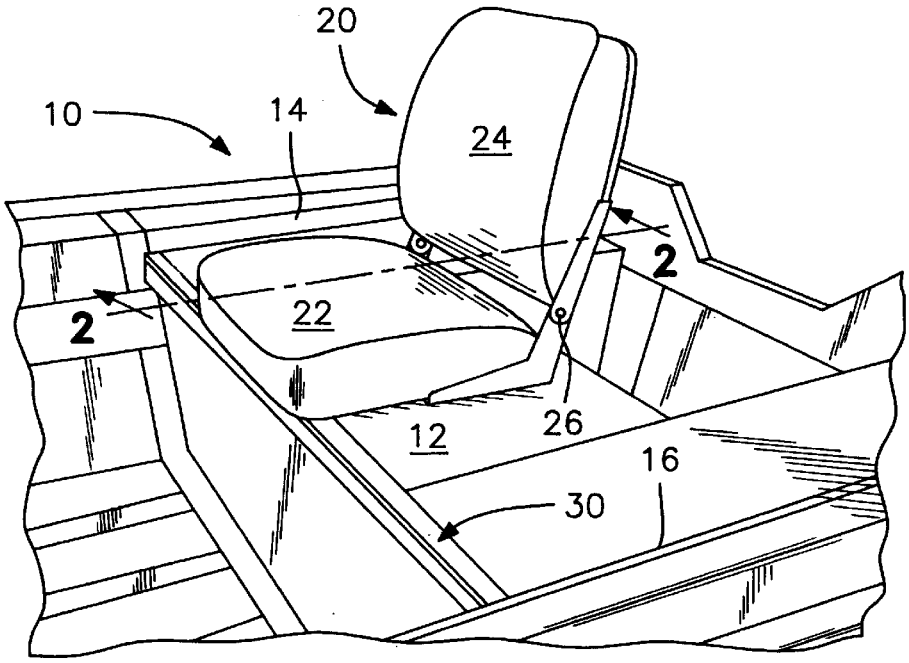
FIG. 1 (PRIOR ART)
FIG. 1 is a perspective fragmentary view of the rear portion of an open boat with a seat engaged with a mounting rail according to a prior art assembly design.

In describing the preferred embodiment of the instant invention as illustrated in the drawings, specific terminology will be resorted to for the sake of clarity. However, the invention is not intended to be limited to the specific terms so selected and it is to be understood that each specific term includes all technical equivalents which operate in a similar manner to accomplish a similar purpose.

Figure 2:
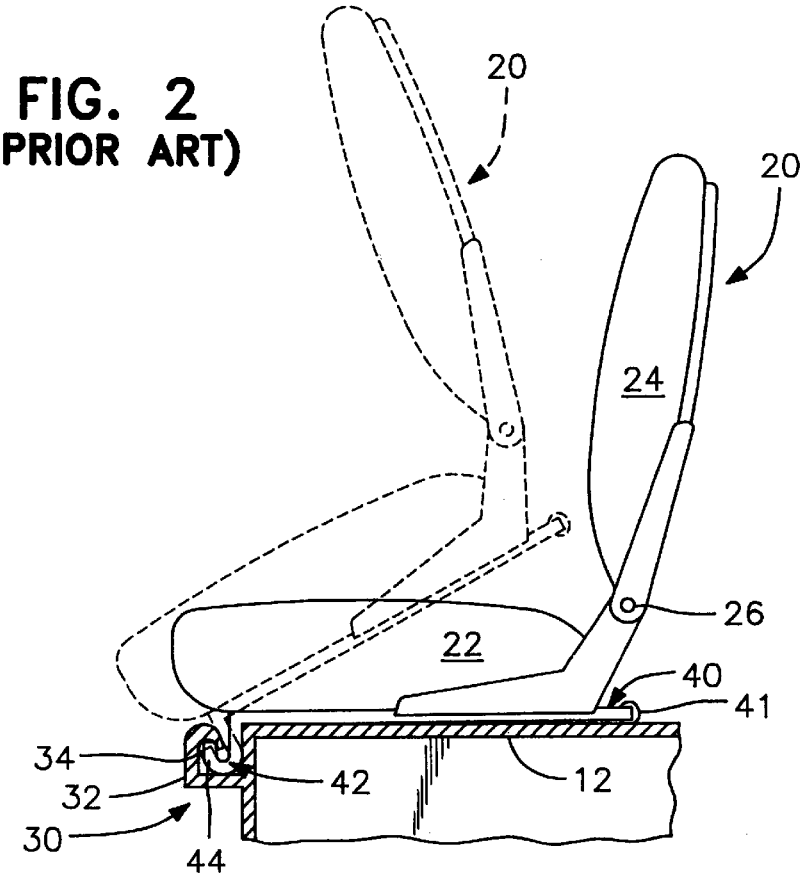
FIG. 2 (PRIOR ART)
FIG. 2 is a fragmentary cross-sectional view taken along lines 2—2 of FIG. 1, showing the seat tilted forwardly in dotted lines as the complementary connectors on the seat mounting plate and the seat mounting rail are engaged using this prior art construction.

Referring now to FIGS. 1 and 2, a prior art boat seat mounting construction currently in use is illustrated. A boat designated generally by the reference numeral 10 is provided with a seat 20 of any standard construction. As shown, the seat 20 may include a seat cushion 22 and a cushioned seat back 24 pivotally interconnected in a well known manner as shown at 26 to enable the seat back 24 to be folded down onto the seat cushion 22, if desired. Obviously, other seat or chair designs may be substituted for the seat 20, the details of which are not important to the instant inventive concepts.

The boat 10 can also be of any conventional construction. The boat 10 shown in FIG. 1 is illustrated as an open fishing boat having a raised rear deck or platform 12 on the forward edge of which a seat mounting rail 30 is carried. The seat mounting rail 30 comprises an upstanding reverted element 32 defining an undercut groove 34 which forms a female connector for securing the seat 20 to the boat deck 12. In the preferred embodiment, the seat mounting rail 30 extends substantially across the full width of the boat between the gunwales 14, 16 so that the chair 20 can be moved sideways or, for that matter, a second seat (not shown) can be mounted in the same seat mounting rail 20.

In the standard seat mounting assembly of the prior art illustrated in FIGS. 1 and 2, a seat mounting plate 40 is affixed to the bottom of the seat 20. At the leading edges of the seat mounting plate 40, a clip 42 is provided in the form of an elongated J-shaped element, the reverted portions 44 of which form a male connector engageable in the undercut groove 34 of the seat mounting rail 30 as shown in dotted lines in FIG. 2 to secure the seat 20 to the seat mounting rail 30 and, thus, to the boat with the seat 20 resting on the boat deck 12 as shown in full lines in FIG. 2.

Although the seat mounting rail 30 is illustrated as including a female connector in the form of the undercut groove 34, and the clip 42 is illustrated as including a male connector in the form of the leading reverted edges 44 engageable in the groove 34, it is only important that these elements define complementary connectors adapted to secure the seat 20 to the boat deck 12. Thus, other interengaging elements may be substituted for the prior art design illustrated without departing from the instant inventive concepts.

If desired, a U-shaped rubber trim element 41 may be secured over the trailing edges of the seat mounting plate 40 for aesthetic purposes and to grip the surface of the boat deck 12 on which it rests.

Figure 3:
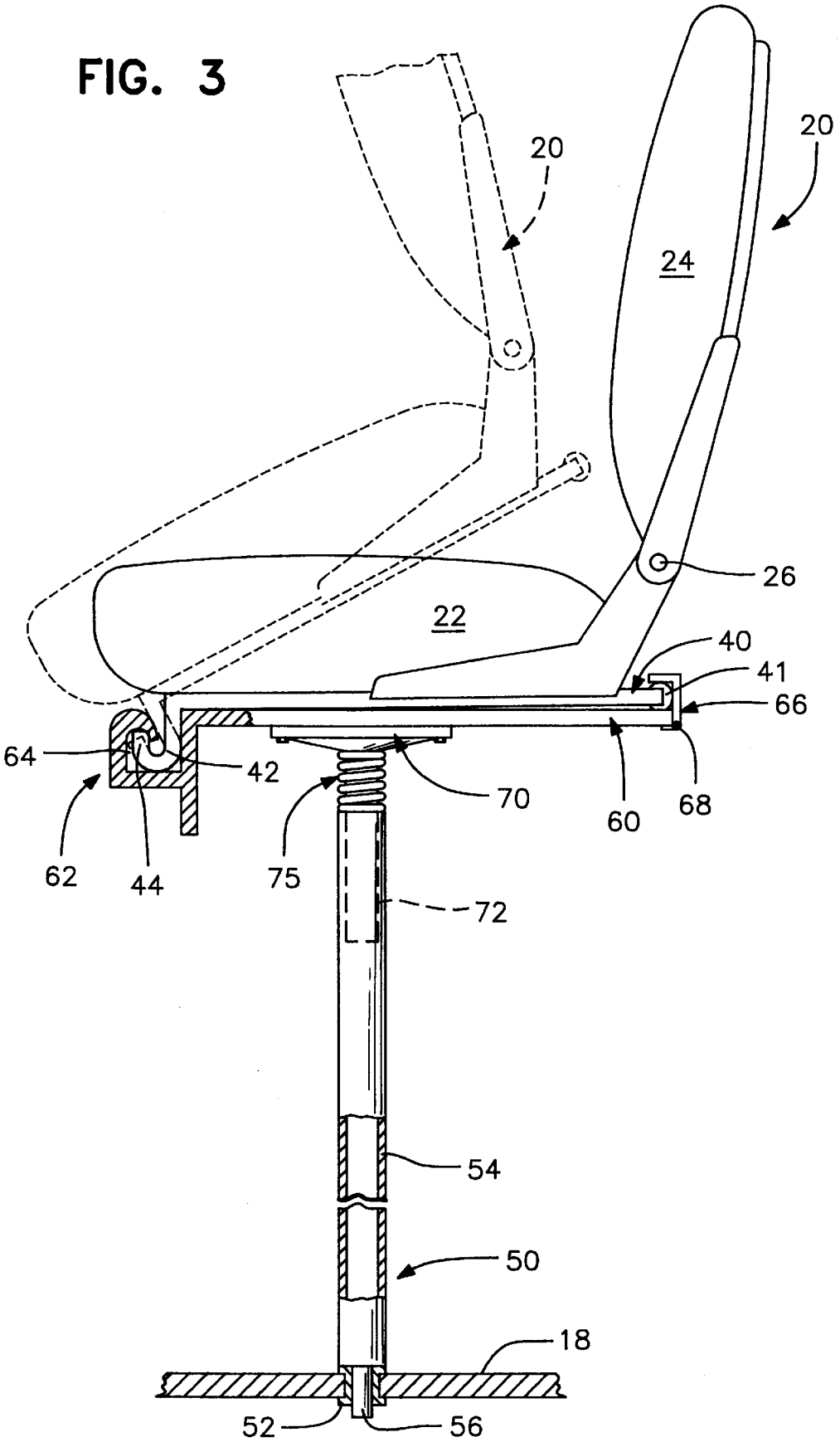
FIG. 3 is a side elevational view, partly in cross-section, showing a seat incorporating a pedestal mounting plate according to the instant inventive concepts to convert the prior art seat mounting assembly of FIGS. 1 and 2 to a pedestal mounted seat, the seat being shown in dotted lines tipped forwardly to illustrate the manner in which the connector of the seat mounting plate is engaged with the pedestal mounting plate rail connector.

The boat 10 is also provided with a pedestal support 50, commonly located in a raised forward deck or platform, a portion of which is illustrated at 18 in FIG. 3. The pedestal support 50 includes a bushing 52 and a pedestal post 54 having a downwardly depending pin 56 rotatably supported in the bushing 52 to enable the seat 20 to be swivelled when it is mounted on the pedestal support 50. As indicated, normally a separate seat or chair assembly would be provided with a conventional spyder carrying a post or pin telescopingly engageable with the top of the pedestal post 54. The instant inventive concepts, however, enable the seat 20 to be modified so it can be selectively removed from its engagement with the seat mounting rail 30 and supported on the pedestal mount 50 at a different location, if desired.

Figure 4:
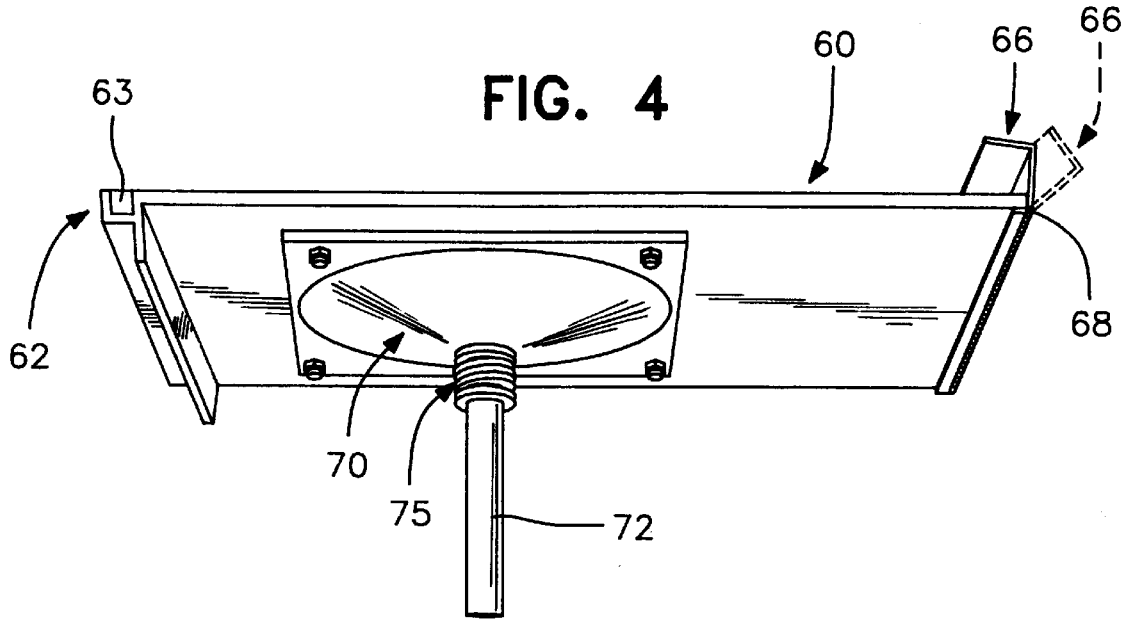
FIG. 4 is a perspective view of the pedestal mounting plate assembly according to the instant inventive concepts, with the spring-pressed catch shown in dotted lines as it would be moved to enable the same to be engaged about the trailing edges of the seat mounting plate.
Figure 5:
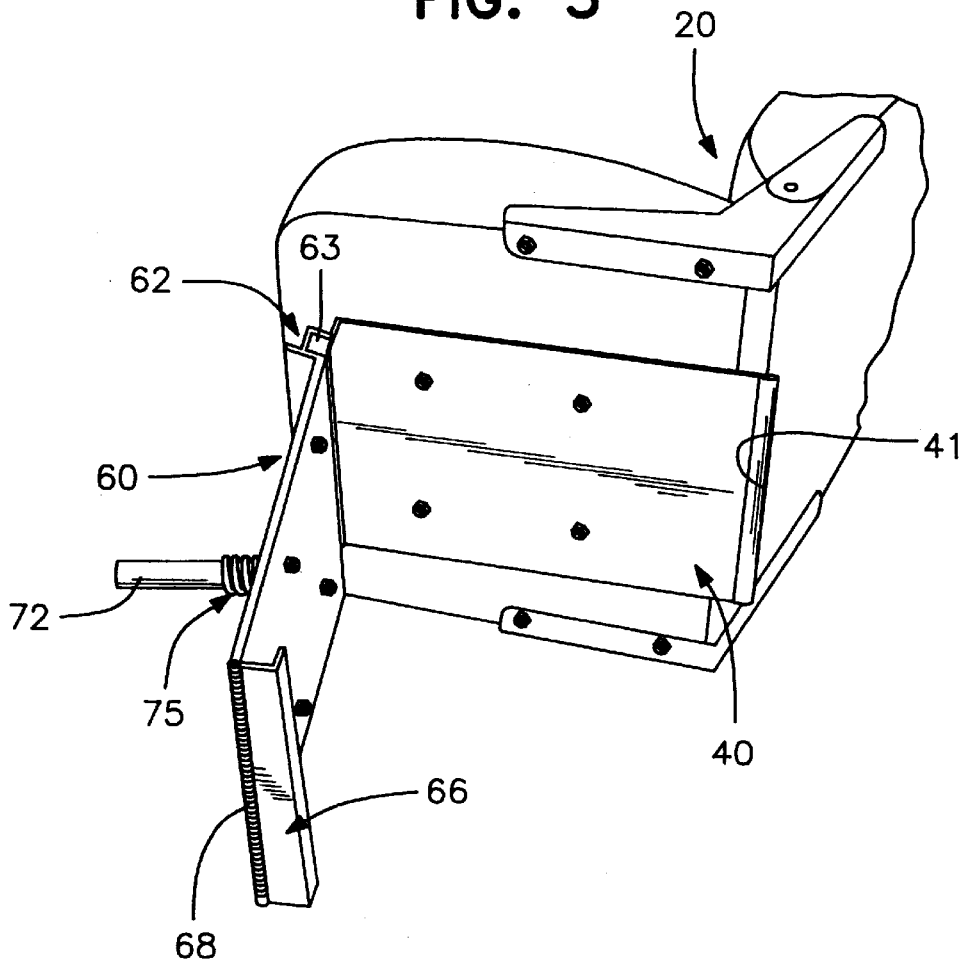
FIG. 5 is a perspective view showing the pedestal mounting plate is being engaged with the standard seat mounting plate of the seat of FIGS. 1 and 2.

In order to accomplish the foregoing, a pedestal mounting plate 60 shown in perspective in FIG. 4 is provided. The pedestal mounting plate 60 includes a pedestal mounting rail 62 at its leading edges which includes connector portions substantially identical in cross-sectional configuration to the connector portions of the seat mounting rail 30. Thus, the pedestal mounting rail 62, in the illustrated embodiment, defines an undercut groove 64 adapted to cooperate with the reverted J-shaped portions 44 of the clip 42 on the seat mounting plate 40 in a manner substantially similar to the manner in which the clip 42 engages the seat mounting rail 30. The pedestal mounting plate 60 is slightly wider than the clip 42 and includes stop elements, one of which is shown at 63, to close the ends of the undercut groove 64 in the pedestal mounting plate rail 62. Thus, once the clip 42 on the seat mounting plate 40 is engaged with the undercut groove 64 in the pedestal mounting plate rail 62, the seat 20 is prevented from sliding free of the pedestal mounting plate rail 62 in use.

The trailing edges of the pedestal mounting plate 60 include a flange element 66 carried by a spring hinge 68 biased toward an upstanding position as shown in FIG. 3 to secure the pedestal mounting plate 60 to the seat mounting plate 20.

A spyder 70 is affixed to the bottom of the pedestal mounting plate 60 and carries a downwardly depending pedestal element 72 telescopingly engageable in the pedestal post 54 as shown in dotted lines in FIG. 3. If desired, a spring 75 may be interposed between the spyder 70 and the top of the pedestal post 54 to provide resilient support for the seat 25 in an obvious manner.

Considering the foregoing, it is evident that the instant invention provides a unique mounting system for selectively attaching the boat seat 20 to either the seat mounting rail 30 on the rear platform 12 or the pedestal support 50 on the front platform 14 of the boat 10. If the seat 20 is to be used on the rear platform 12, the clip 42 is engaged in the seat mounting rail 30 in the manner shown in FIG. 2. If it is desired to use the same seat 20 on the pedestal support 50, it is removed from the seat mounting rail 30 on the boat by reversing the engagement as shown in dotted lines in FIG. 2. With the pedestal element 72 of the spyder 70 engaged in the pedestal post 54, the clip 42 on the seat mounting plate 40 is then engaged in the pedestal mounting plate rail 62 as shown in dotted lines in FIG. 3, with the catch 64 resiliently engaged over the trailing edges or the rubber bushing 41 on the seat mounting plate 40 as shown in FIG. 3.

While the seat mounting rail 30 has been shown and described with reference to an elevated rear platform 12 in an open boat 10, and the pedestal support 50 has been shown and described with respect to an elevated front platform 14 in the boat, obviously, the location of these elements on the boat is not important to the instant inventive concepts. In fact, seat mounting rails and pedestal supports can both be positioned at any location, as desired. Regardless, the multifunction boat seat mount of the instant invention enables a single seat or chair assembly to be selectively and easily secured in either of two configurations, i.e., for use as a conventional seat resting on a portion of the boat deck, or as a raised or pedestal seat.

It will be recognized that, with the unique mounting system of this invention, the number of seats or chairs carried by the boat can be minimized since each seat may be readily converted to alternative uses. Moreover, there is no need for tools of any kind to modify a single seat assembly for selective attachment to either a conventional seat mounting rail or a pedestal support.

The foregoing description should be considered as illustrative only of the principles of this invention. Since numerous other modifications and changes will readily occur to those skilled in the art, it is not desired to limit the invention to the exact construction and operation shown and described and, accordingly, all suitable modifications and equivalents may be resorted to, without departing from the scope of the invention.

What is claimed is:

1. In a mounting system for selectively attaching a boat seat to a seat mounting rail defining one of a pair of complementary male and female connectors, or to a pedestal support, wherein the mounting system includes a seat mounting plate on the bottom of the seat having opposed sides and leading and trailing edges, a clip on the leading edges of the seat mounting plate defining the other of the pair of complementary male and female connectors and being removably engageable with the seat mounting rail connector to selectively secure the seat to the seat mounting rail in a first position on the boat, the improvement which comprises a pedestal mounting plate adapted to be removably attached to the seat mounting plate, said pedestal mounting plate including a top, a bottom, opposed sides and leading and trailing edges, a pedestal mounting plate rail on said leading edges of said pedestal mounting plate, said pedestal mounting plate rail defining a connector having a configuration substantially the same as the seat mounting rail connector, a catch resiliently carried by said trailing edges of said pedestal mounting plate for engaging the trailing edges of the seat mounting plate to removably secure said pedestal mounting plate to the seat mounting plate when the clip on the seat mounting plate is engaged with said pedestal mounting plate rail, and a pedestal element carried by said bottom of said pedestal mounting plate for removable engagement in the pedestal support to selectively secure the seat to the pedestal support in a second position on the boat.

2. The improvement of claim 1 wherein the seat mounting rail and the pedestal support are in remote locations on the boat.

3. The improvement of claim 1 wherein the seat mounting rail connector comprises an undercut groove, said pedestal mounting plate rail connector comprises an element carried by said leading edges of said pedestal mounting plate defining an undercut groove corresponding in configuration to the undercut groove defined in the seat mounting rail connector, and the clip on the seat mounting plate comprises a depending element with reverted terminal edge portions adapted to be selectively engaged in the undercut groove defined in the seat mounting rail connector or said undercut groove defined in said pedestal mounting plate connector.

4. The improvement of claim 3 wherein said clip is an elongated element which is J-shaped in cross-section.

5. The improvement of claim 4 wherein said clip extends substantially along the full width between the opposed sides of the seat mounting plate.

6. The improvement of claim 3 wherein said pedestal mounting plate rail is wider than the clip, further including stop elements closing the ends of said undercut groove in said pedestal mounting plate rail to prevent the clip on the seat mounting plate from sliding free of said pedestal mounting plate rail in use.

7. The improvement of claim 1 wherein said catch comprises a flange element, further including a spring-loaded hinge securing said flange element to said trailing edges of said pedestal mounting plate and normally biasing said flange element to an upstanding position for locking engagement with the trailing edges of the seat mounting plate.

8. The improvement of claim 1 wherein the pedestal support includes a bushing element and a pedestal pole having one end rotatably mountable in the bushing element, and said pedestal element telescopingly interconnects with the opposite end of the pedestal pole.

9. A boat including a seat to be selectively mounted on said boat in one of at least two positions, at least one of said positions including a seat mounting rail defining one of a pair of complementary male and female connectors, and at least one other position including a pedestal support, a multi-function mounting system for said seat, said multi-function mounting system comprising a seat mounting plate on the bottom of said seat, said seat mounting plate having opposed sides and leading and trailing edges, a clip on the leading edges of said seat mounting plate defining the other of said pair of complementary male and female connectors and being removably engageable with said seat mounting rail connector to selectively secure said seat to said seat mounting rail in said one position on the boat, a pedestal mounting plate adapted to be removably attached to said seat mounting plate, said pedestal mounting plate including a top, a bottom, opposed sides and leading and trailing edges, a pedestal mounting plate rail on said leading edges of said pedestal mounting plate, said pedestal mounting plate rail defining a connector having a configuration substantially the same as said seat mounting rail connector, a catch resiliently carried by said trailing edges of said pedestal mounting plate for engaging said trailing edges of said seat mounting plate to removably secure said pedestal mounting plate to said seat mounting plate when said clip on said seat mounting plate is engaged with said pedestal mounting plate rail, and a pedestal element carried by said bottom of said pedestal mounting plate for removable engagement in said pedestal support to selectively secure said seat to said pedestal support in said other position on the boat.

10. The boat of claim 9 including a front platform and a rear platform, said seat mounting rail being carried by said rear platform, and said pedestal support being carried by said front platform.

11. The boat of claim 9 wherein said seat mounting rail connector comprises an undercut groove, said pedestal mounting plate rail connector comprises an element carried by said leading edges of said pedestal mounting plate defining an undercut groove corresponding in configuration to said undercut groove defined in said seat mounting rail connector, and said clip on said seat mounting plate comprises a depending element with reverted terminal edge portions adapted to be selectively engaged in said undercut groove defined in said seat mounting rail connector or said undercut groove defined in said pedestal mounting plate connector.

12. The boat of claim 11 wherein said clip is an elongated element which is J-shaped in cross-section.

13. The boat of claim 12 wherein said clip extends substantially along the full width between the opposed sides of said seat mounting plate.

14. The boat of claim 11 wherein said pedestal mounting plate rail is wider than said clip, further including stop elements closing the ends of said undercut groove in said pedestal mounting plate rail to prevent said clip on said seat mounting plate from sliding free of said pedestal mounting plate rail in use.

15. The boat of claim 9 wherein said catch comprises a flange element, further including a spring-loaded hinge securing said flange element to said trailing edges of said pedestal mounting plate and normally biasing said flange element to an upstanding position for locking engagement with said trailing edges of said seat mounting plate.

16. The boat of claim 9 wherein said support base includes a bushing element and a pedestal pole having one end rotatably mounted in said bushing element, and said pedestal element telescopingly interconnects with the opposite end of said pedestal pole.

* * * * *